US006494022B1

(12) United States Patent
Aylward

(10) Patent No.: US 6,494,022 B1
(45) Date of Patent: Dec. 17, 2002

(54) ORBITAL MOTION PILL PACKAGING DEVICE AND ASSOCIATED METHOD

(75) Inventor: John Thomas Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 0 days.

(21) Appl. No.: 09/458,916

(22) Filed: Dec. 10, 1999

(51) Int. Cl.[7] ..... B65B 1/04

(52) U.S. Cl. ..... 53/473; 53/475; 53/244; 53/246; 53/900

(58) Field of Search ..... 53/473, 475, 900, 53/235, 244, 249, 250, 158, 246; 100/211; 493/172, 173

(56) References Cited

U.S. PATENT DOCUMENTS

| | | | |
|---|---|---|---|
| 2,833,091 A | | 5/1958 | Whitney |
| 3,530,639 A | | 9/1970 | Bross |
| 3,722,087 A | | 3/1973 | Berg |
| 3,851,442 A | * | 12/1974 | Miles |
| 4,074,509 A | * | 2/1978 | Miles |
| 4,204,610 A | | 5/1980 | Schlaepfer |
| 4,265,072 A | | 5/1981 | Egli |
| 4,693,057 A | | 9/1987 | Rittinger et al. |
| 5,737,902 A | | 4/1998 | Aylward |
| 5,765,342 A | | 6/1998 | Jensen et al. |

FOREIGN PATENT DOCUMENTS

| | | |
|---|---|---|
| DE | 39 38 296 A | 5/1991 |
| GB | 1 067 750 A | 5/1967 |
| GB | 1 208 674 A | 10/1970 |

* cited by examiner

*Primary Examiner*—Eugene Kim
(74) *Attorney, Agent, or Firm*—Alston & Bird LLP

(57) ABSTRACT

A packaging device for a pill packaging apparatus is provided, wherein the packaging device is used for inserting pills into a series of pill receptacles being conveyed generally horizontally thereunder. The packaging device generally comprises a resilient pad driven in an orbital motion. The orbitally driven resilient pad is brought into engagement with pills protruding from the pill receptacles. The orbital motion of the resilient pad imparts a rotational motion to the pills in contact with the pad and thereby urges the protruding pills into the receptacles. An associated method of packaging pills is also provided.

27 Claims, 4 Drawing Sheets

ORBITAL MOTION PILL PACKAGING DEVICE AND ASSOCIATED METHOD

FIELD OF THE INVENTION

The present invention relates to pill packaging devices and methods and, more particularly, to an orbital motion device and associated method for packaging pills, tablets, capsules, and the like.

BACKGROUND OF THE INVENTION

Pharmaceutical products such as pills, tablets, capsules, and the like are often packaged in disposable packaging for distribution to the consumer. Such disposable packaging includes thermoformed and cold formed blister packages as well as pouches, sachets, or disposable bottles.

Conventional blister packages typically include a generally planar web portion having a plurality of receptacles formed therein. A thermoforming process, for example, can be used to form the receptacles in a thermoplastic web. Each receptacle in the web may receive one or more pills and the receptacles may be arranged in a grid pattern having multiple rows and/or columns. After pills have been placed in all of the receptacles, an aluminum or plastic foil layer is adhered to the planar web portion to seal the pills within the receptacles.

An important aspect of forming these packages relates to the placement of the pills in the receptacles prior to the foil layer being applied. This procedure is preferably performed by an automated machine capable of precisely and accurately placing the pills into the receptacles at a high speed. An exemplary form of such an apparatus has been commercially available under the name, "Aylward Feed System" from Aylward® Enterprises, Inc. of New Bern, N.C., also the assignee of the present invention. The Aylward Feed System includes a feeder cassette and drop chute assembly having a plurality of chutes for guiding pills into the appropriate receptacles. An orienting tray is positioned above the feeder cassette for passing pills into the feeder cassette which, in turn, passes the pills into the drop chutes.

The orienting tray, the feeder cassette, and the drop chute assembly are mounted on a frame which extends over a conveyor having a series of empty pill blister packages placed thereon. The frame is generally movable in registration with the pill packages moving thereunder. The frame is fixed in the horizontal direction of the conveyor if the conveyor is an intermittent type. If the conveyor is a continuous type, the frame is moved on an undercarriage driven at the same speed as the conveyor. Therefore, with a continuous conveyor, the frame "gallops" back to register and moves with the next blister package after the preceding package has been filled.

Accordingly, as an empty pill package is moved under the drop chute, the drop chute is lowered and an escapement mechanism is activated in the feeder cassette to release a single pill which falls through the drop chute and into the corresponding receptacle in the package. More particularly, for example with blister packages, the drop chute is lowered and a pill is released to fall through the drop chute until it engages the bottom of the blister. The frame is then raised which, in turn, raises the drop chute and deposits the pill in the blister. This operation defines a gravity feed pill packaging system.

The drop chute assembly may include a plurality of individual chutes arranged in a block so as to define a grid.

Each of the chutes extends in a generally vertical direction, but may include a portion at the lower end thereof which is angled so that a pill exiting the drop chute does so at an acute angle relative to the blister package.

In operation, where a pill is being packaged in a loose-fitting receptacle, this type of system will often place a pill into the blister receptacle by sliding a pill down the drop chute, wherein the lower end thereof is angled so that a pill exiting the drop chute is placed in the blister package at an acute angle relative thereto. Since the pill is deposited into the receptacle at an angle, it will sometimes "slide" into the receptacle until the leading edge of the pill engages a side wall thereof The drop chute is then moved away from the blister receptacle to allow the trailing edge of the pill to clear the drop chute and drop into the receptacle under the force of gravity. Thus, the pill is introduced to the receptacle, essentially diagonally, at an angle corresponding to the angle of the lower end of the drop chute. An apparatus and method of this type for packaging pills is disclosed in U.S. Pat. No. 5,737,902 to Aylward, which is incorporated herein in its entirety by reference.

Although these types of feeders have achieved widespread commercial acceptance, problems may arise if the pills are being deposited into a package having receptacles which are closely toleranced or "tight fitting" with respect to the dimensions of the pills. Tight fitting receptacles are desirable in some instances, such as in blister packaging, wherein the tight tolerances minimize rattling of the pills within the receptacles. However, where a pill is to be inserted into a tightly toleranced receptacle using these types of systems, the pill may not be capable of simply being slid into the receptacle in a diagonal orientation.

For example, for a caplet which is generally in the shape of a transversely flattened capsule, the dimensions of the receiving receptacle in the blister package may be only slightly greater than the dimensions of the caplet. That is, the overall length and width of the receptacle may only be slightly greater than the overall length and width of the caplet, respectively. Accordingly, when the caplet is slid into the receptacle at an angle with the leading edge of the caplet dropping into the receptacle and engaging a side wall thereof before the trailing edge is released, the caplet may become oriented with its diagonal dimension approximately parallel or angled slightly upward relative to the planar web portion of the blister package. In this situation, the maximum dimension of a longitudinal cross-section of the caplet, here the diagonal dimension, may be slightly greater than the length of the accommodating receptacle and thus the trailing edge of the caplet will lie against a portion of the side wall of the receptacle, above the bottom wall thereof The force of gravity may not be sufficient to cause the pill to drop fully into the receptacle, which leaves part of the trailing edge of the caplet extending above the planar web portion of the blister packet. This can also occur if the blister package material is wrinkled or otherwise distorted in the bottom or sides of the receptacle. In some instances, a caplet or pill may even "stand up" on its leading edge within a receptacle. As would be appreciated, these occurrences may have an adverse effect on the subsequent application of the foil layer if the trailing edge of the caplet extends above the plane of the blister package.

Thus, there exists a need for an improved packaging apparatus and method for placing pills and the like into pill receptacles such as blister packages in a preferred orientation, more particularly in the receptacle and below the planar web portion of the blister package, before application of a sealing foil layer. Such an apparatus and method should be able to quickly and accurately insert the pills, even the pills which are "standing up," into the receptacles to provide high packaging speed and quality. Such an apparatus and method should also be capable of efficiently and reliably inserting pills into receptacles dimensioned in close tolerance to said pills.

SUMMARY OF THE INVENTION

The above and other needs are met by the present invention which, in one embodiment, provides a packaging device for a pill packaging apparatus, wherein the packaging device is used for inserting pills into a series of pill receptacles being conveyed generally horizontally thereunder. The packaging device generally comprises a rotationally-driven shaft and a resilient pad eccentrically coupled to the shaft, the shaft then driving the resilient pad in an orbital motion. In one advantageous embodiment, the resilient pad is capable of being brought into engagement with pills protruding from the pill receptacles. The orbital motion of the resilient pad thereby urges the protruding pills into the receptacles.

More particularly, the present invention comprises a pill packaging apparatus for packaging pills in a series of pill receptacles, comprising a conveyor for conveying a series of pill receptacles generally horizontally therealong, a feeder mechanism extending over the conveyor for supplying pills into the pill receptacles in a predetermined manner, and a packaging device disposed downstream of the feeder mechanism with respect to the conveyor. The packaging device may further comprise an eccentric coupled between the shaft and the resilient pad, wherein the eccentric is adjustable to vary the breadth of the orbital motion of the resilient pad. The resilient pad may be comprised of, for example, a rubber material or may comprise a frame having a fabric stretched tautly thereacross and attached thereto. Where the resilient pad comprises a fabric covered frame, the frame is configured to at least extend over the width of the pills in the receptacles such that only the fabric engages the pills protruding therefrom throughout the breadth of the orbital motion of the resilient pad. In addition, the fabric may be comprised of, for example, a stainless steel cloth or other material approved by the appropriate regulatory authority for use in the packaging of pharmaceuticals, wherein the material is preferably capable of contacting the pills without causing damage thereto. In some instances, the packaging device is further adapted to provide downward force on the pills protruding from the receptacles, in addition to the orbital motion imparted to the pills by the resilient pad. For example, the resilient pad may be configured such that the weight of the pad provides the downward force on pills protruding from the pill receptacles. Alternatively, a separate urging device operably connected to the resilient pad may urge the resilient pad toward the pill receptacles to provide the downward force on the pills protruding therefrom.

A further advantageous aspect of the present invention comprises a method for packaging pills in individual receptacles in a blister package. First, pills are fed into the receptacles. A resilient pad is then moved adjacent to the receptacles such that the resilient pad engages pills protruding therefrom. An orbital motion is then imparted to the resilient pad to urge the protruding pills into the receptacles. In some instances, the method may further include the step of imparting a downward force on pills protruding from the receptacles following the step of removing the resilient pad adjacent to the receptacles.

Thus, the pill packaging device and associated method according to embodiments of the present invention are capable of inserting pills into pill receptacles in an orientation below the planar web portion of the blister package before the sealing foil layer is applied. The apparatus and method target pills which are protruding from, and even "standing up" in, the pill receptacles and impart an orbital motion thereto to quickly and accurately insert the pills into the receptacles and thereby provide high packaging speed and quality. In this manner, the apparatus and method according to embodiments of the present invention are capable of inserting pills into receptacles where the receptacles are dimensioned in close tolerance to the pills. It will be recognized, therefore, that the invention facilitates the achievement of a number of distinct advantages over prior art pill packaging devices.

BRIEF DESCRIPTION OF THE DRAWINGS

Some of the advantages of the present invention having been stated, others will appear as the description proceeds, when considered in conjunction with the accompanying drawings, which are not necessarily drawn to scale, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
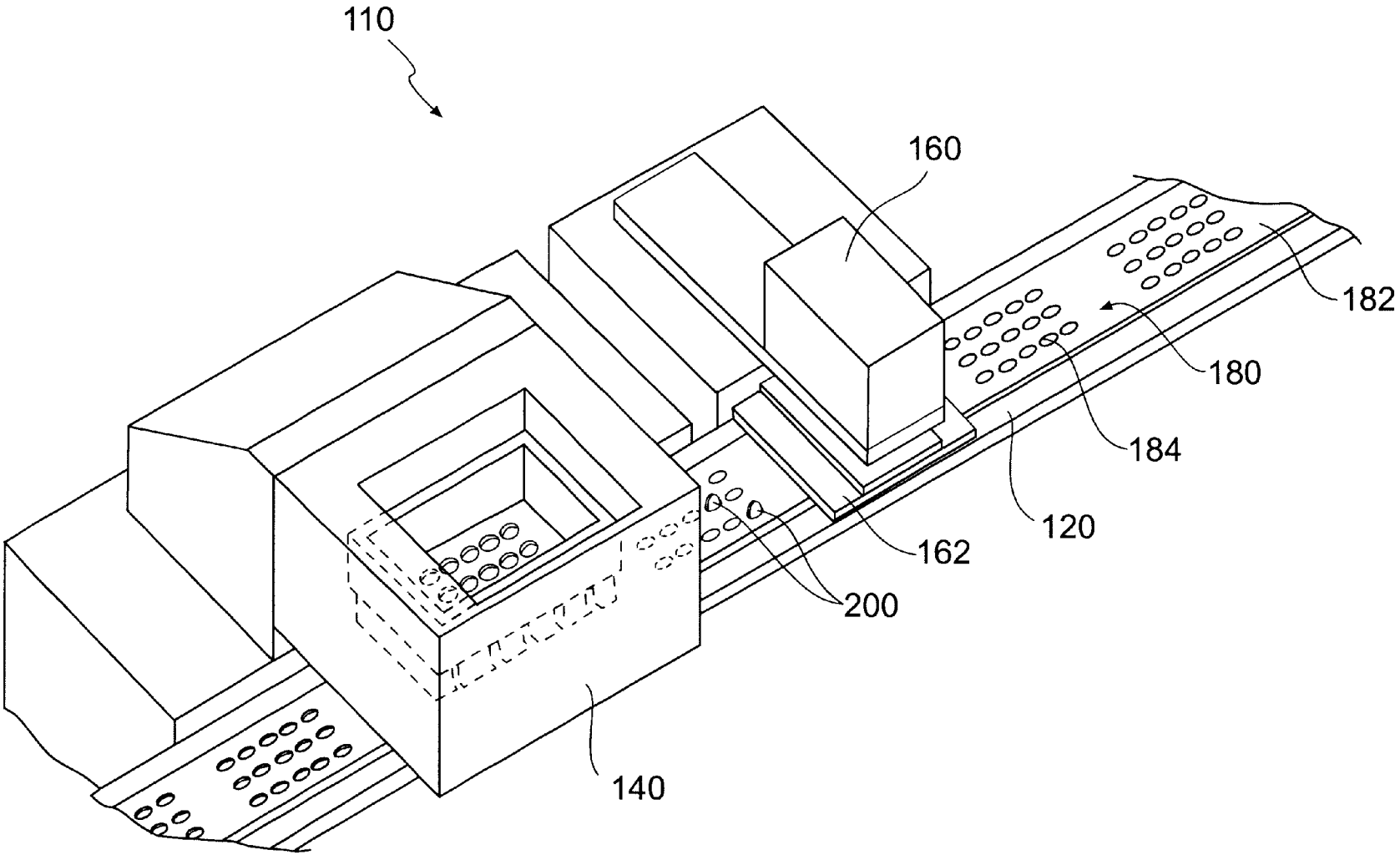
FIG. 1 is a perspective view of a pill packaging apparatus for packaging pills into a series of pill receptacles according to one embodiment of the present invention.
Figure 2:
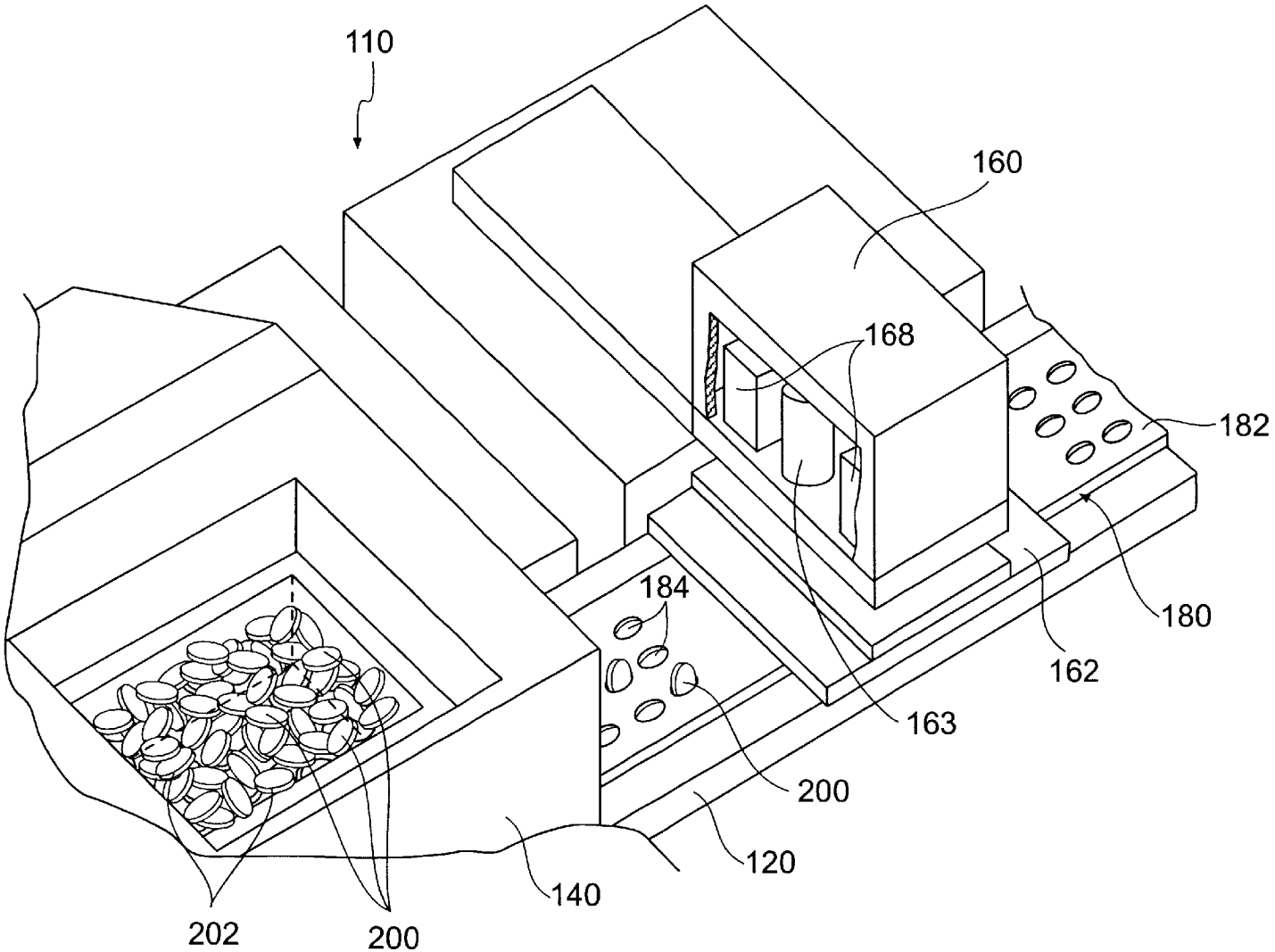
FIG. 2 is a fragmented perspective view of a packaging device according to one embodiment of the present invention.

FIGS. 1 and 2 disclose one embodiment of a pill packaging apparatus, indicated generally by the numeral 110, for packaging pills in a series of pill receptacles. The pill packaging apparatus 110 generally comprises a conveyor 120, a feeder mechanism 140 extending over the conveyor 120, and a packaging device 160 disposed downstream of the feeder mechanism 140 with respect to the conveyor 120. Typically, the conveyor 120 conveys a series of blister packages 180 generally horizontally along the travel path of the conveyor 120. The feeder mechanism 140 supplies pills 200 into the blister packages 180 in a predetermined manner as the blister packages 180 are transported by the conveyor 120. A more detailed description of an apparatus having a feeder mechanism for supplying pills into a series of pill receptacles being transported on a conveyor thereunder may be found, for example, in U.S. Pat. No. 5,737,902 to Aylward.

As used herein, the term "pill" is intended to include all types of small discrete products of the type which may be used in the pharmaceutical industry, including pills, tablets, capsules, caplets, and soft gel caplets or the like. Similarly, the packages are illustrated as blister packages having blisters which may be formed by thermoforming if the packages are made from a thermoplastic material. It will be understood, however, that the present invention is not limited to placing pills into blister packages, but indeed may be used for placing pills into a variety of different pill receptacles. In addition, it will be understood that the present invention is not limited to placing pills into disposable pill packages, but may also be used for placing pills into reusable holders so that the pills may then be transferred to other operations, such as a pill placement device for moving the pills from the holder into a disposable package.

The blister packages 180 typically comprise, for instance, a generally planar web portion 182 and a plurality of receptacles 184 extending below the web portion 182. As the blister packages 180 pass underneath the feeder mechanism 140, at least one pill 200 is typically released into each receptacle 184. Once pills 200 have been fed into each receptacle 184, the receptacles 184 are typically sealed with a foil or other sealing layer (not shown) applied to the planar web portion 182.

In some instances, for example, where the receptacles 184 are dimensioned in close tolerance to the pills 200, the pills 200 may not lie flat within the receptacles 184 after being deposited therein by the feeder mechanism 140. The pills 200 may lie against the opening of the receptacle 184 at the planar web portion 182 or, where the pills 200 have a flat band 202 extending around the perimeter thereof, the pills 200 may even "stand up" on the band 202 within the receptacle 184. In such instances, the foil sealing layer may be difficult to apply to the planar web portion 182 to seal the receptacles 184. Thus, after each blister package 180 has passed under the feed mechanism 140 and received pills 200 therein, the blister packages 180 are serially conveyed downstream by the conveyor 120 to pass under the packaging device 160 for urging any protruding pills 200 into the desired flat orientation within the individual receptacles 184.

Figure 4:
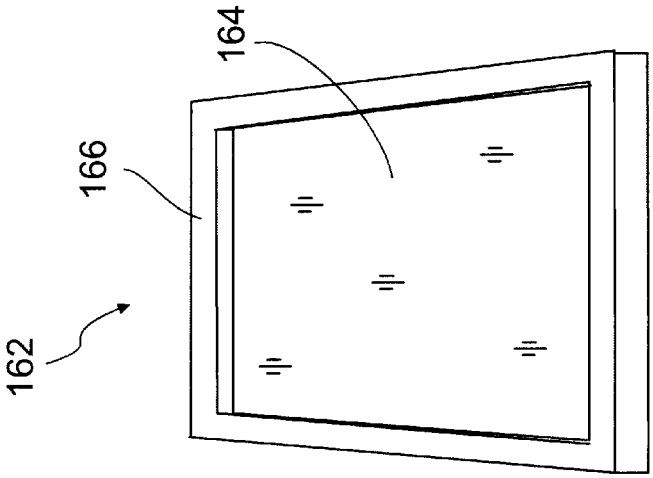
FIG. 4 is a perspective view of a resilient pad comprising a frame having a fabric tautly stretched thereover and attached thereto according to one embodiment of the present invention.

According to one advantageous embodiment of the present invention, the packaging device 160 comprises a resilient pad 162 extending at least across the width of the pills 200 within the receptacles 184 and being moveable in an orbital motion. The pad 162 may comprise, for example, a pliable and resilient material such as rubber or the like. In an alternative embodiment, the pad 162 may comprise, for instance, a fabric 164 tautly stretched over a rigid frame 166 as shown in FIG. 4. The frame may include a solid aluminum plate where the portions above each of the receptacles have been milled out to create depressions in the undersurface of the plate into which the fabric is pushed slightly when engaging the pills. The fabric 164 may comprise, for example, a fine stainless steel cloth or a like material approved by the appropriate regulatory agency as being suitable for use in pharmaceutical packaging operations. The pad 162 or the fabric 164 can be removable and replaceable to allow subsequent processing of pills of a different type, thereby eliminating concerns of cross-contamination.

In one particularly advantageous embodiment, the pad 162 is eccentrically driven in an orbital motion by, for example, a rotating eccentric or cam (not shown), wherein the dimension of the orbit is adjustable. For example, the diameter of a circle circumscribed by a fixed point on the pad may be about 10 mm when the pills are packaged on 12 mm centers. As such, blister packages where pills of two different types are packaged together, such as birth control pills, can be engaged by the pad 162 without any portion of the pad coming into contact with pills in two different receptacle positions. In this manner cross-contamination between different pills in the same package is not a concern. In some instances, the pad 162 may be moved in a circular motion. The pad 162 may be imparted the rotational or eccentric motion by an operably connected motion-inducing device 163 driving the cam or eccentric such as, for example, a pneumatically-driven or electric motor or an air cylinder solenoid or servo actuating a rack and pinion device.

Figure 3:
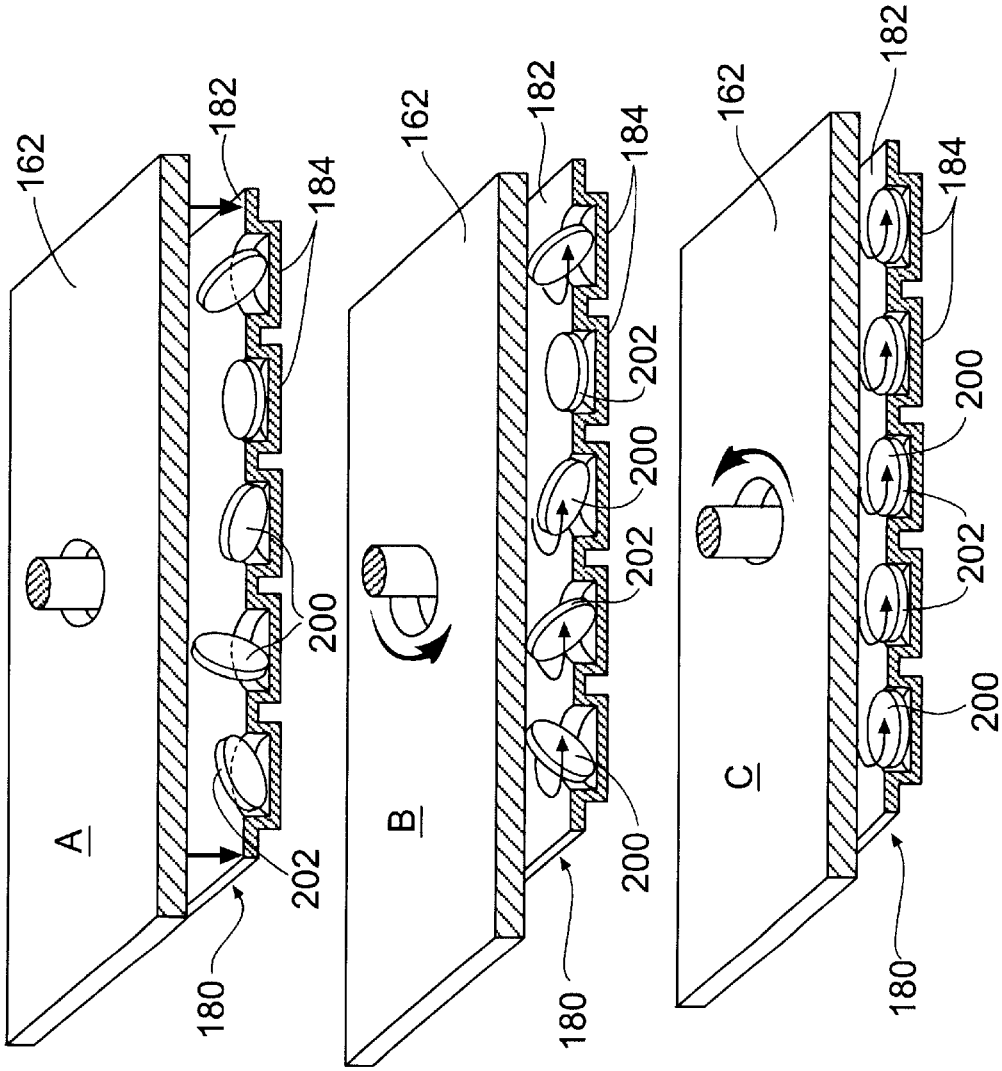
FIG. 3 is a sequence of schematic views of a resilient pad having an orbital motion according to one embodiment of the present invention engaging a pill in a blister package to cause the pill to lie down in the receptacle.

As with the feeder mechanism 140, the packaging device 160 is suspended above the blister packages 180 on the conveyor 120. As shown in FIG. 3, as the receptacles 184 containing pills 200 pass underneath the packaging device 160, the pad 162 is lowered or otherwise brought to a predetermined position above the receptacles 184 as shown in FIG. 3A, typically to a position where the pad 162 comes into contact with pills 200 protruding from the receptacles 184. The orbital motion is then applied to the pad 162 which, in turn, imparts a rotation to the individual pill 200 about an axis projecting through the pill 200 as shown in FIG. 3B. The rotational motion imparted to the pill 200 by the pad 162 upsets the balance of a pill 200 standing on edge, or otherwise protruding from the receptacles 184, and causes the pill 200 to fall over or be otherwise urged into the desired position within the individual receptacle 184 as shown in FIG. 3C. The orbital motion may continue in the same rotary direction until all the pills have been laid down, or the motion may include orbiting in one direction for a certain rotary duration, such as, for example, 270°, followed by a similar orbital motion in the opposite direction.

At the same time that the rotational motion is imparted to the pills 200 by the pad 162, the pad 162 may also be urged toward the blister package 180 in order to assist in the insertion of the pill 200 into the receptacle 184. The pad 162 may be urged towards the receptacles 184 by, for example 162, the weight of the pad 162 or one or more devices, such as a spring, motor, or air cylinder, operably connected to the pad 162 for urging the pad 162 toward the blister package 180. Thus, the combination of the orbital motion and the force imparted toward the blister package 180 by the pad 162 inserts the pills 200 into the individual receptacles 184. In some instances, sensors (not shown) may be provided to indicate when the pills 200 have been inserted into the receptacles 184 in the desired position. The packaging device 160 may then be registered with a subsequent blister package 180 filled with pills 200 and leaving the feeder mechanism 140.

The pad 162 may be raised and lowered with respect to the blister packages 180 disposed on the conveyor 120 by at least one actuator 168 such as, for example, an air cylinder or electric motor. The pill packaging apparatus 110 may also configured such that the pad 162 is capable of operating as described with both a continuous motion pill packaging apparatus and an indexing pill packaging apparatus. With an indexing pill packaging apparatus, the pad 162 is implemented at each successive index of the blister packages 180 from the feeder mechanism 140 as previously described. With a continuous motion pill packaging apparatus, the pad 162 is lowered into the desired position with respect to a filled blister package 180 and moved synchronously with the conveyor 120 and in an orbital motion until the pills 200 have been inserted into the receptacles 184. The pad 162 is then raised and returned to register to await the next blister package 180.

Figure 5:
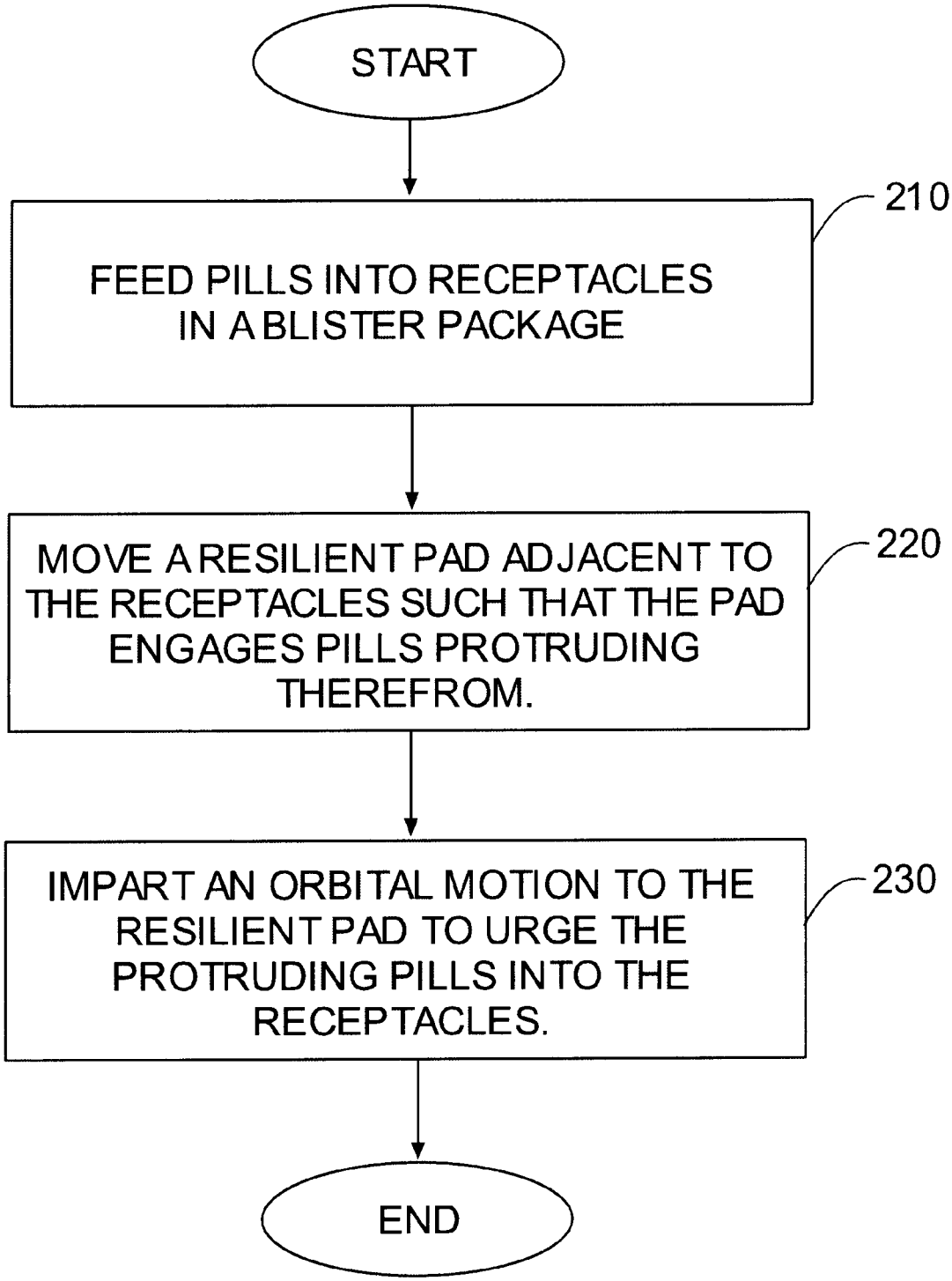
FIG. 5 is a flow chart illustrating a method of packaging pills in individual receptacles in a blister package according to one embodiment of the present invention.

A further advantageous aspect of the present invention comprises a method of packaging pills in individual receptacles in a blister package as shown in FIG. 5. First, pills are fed into the receptacles in the blister package (block 210). A resilient pad is then moved adjacent to the receptacles such that the resilient pad engages pills protruding therefrom (block 220). An orbital motion is then imparted to the resilient pad to urge the protruding pills into the receptacles (block 230). In some instances, the method may further include the step of imparting a downward force on the pills protruding from the receptacles, by way of the pad, following the step of moving the resilient pad adjacent to the receptacles. In this manner, the pills are inserted into the receptacles in the desired orientation in an efficient manner.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A pill packaging apparatus for packaging pills in a series of pill receptacles, said pill packaging apparatus comprising:

a conveyor for conveying a series of pill receptacles generally horizontally therealong;

a feeder mechanism extending over the conveyor for supplying pills into the pill receptacles in a predetermined manner; and a packaging device disposed downstream of the feeder mechanism with respect to the conveyor, the packaging device defining an axis and comprising a resilient pad in laterally displaced relation from the axis, the resilient pad being configured so as to be eccentrically driven about the axis in an orbital motion, the resilient pad being further capable of being brought into engagement with pills protruding from the pill receptacles, the orbital motion of the resilient pad thereby urging the protruding pills to lie flat in the receptacles.

2. A pill packaging apparatus according to claim 1 further comprising a rotationally-driven shaft defining the axis, the resilient pad being coupled to the shaft in laterally displaced relation from the axis such that the resilient pad is eccentrically driven by the shaft in an orbital motion.

3. A pill packaging apparatus according to claim 2 further comprising an eccentric coupled between the shaft and the resilient pad, wherein the eccentric is adjustable to vary the lateral displacement of the resilient pad from the axis and to thereby vary the breadth of the orbital motion of the resilient pad.

4. A pill packaging apparatus according to claim 1 wherein the resilient pad is comprised of a rubber material.

5. A pill packaging apparatus according to claim 1 wherein the resilient pad comprises a frame having a fabric stretched tautly thereacross and attached thereto, the frame being configured to extend over the width of the pills such that only the fabric contacts the pills protruding from the receptacles throughout the breadth of the orbital motion of the resilient pad.

6. A pill packaging apparatus according to claim 5 wherein the fabric comprises a stainless steel cloth.

7. A pill packaging apparatus according to claim 1 wherein the packaging device is further adapted to provide downward force on pills protruding from the pill receptacles in addition to the orbital motion imparted thereto by the resilient pad.

8. A pill packaging apparatus to claim 7 wherein the device is structured such that the weight of the resilient pad lowers the pad and provides downward force on pills protruding from the pill receptacles, in addition to the orbital motion imparted thereto by the resilient pad.

9. A pill packaging apparatus according to claim 7 further including an urging device for urging the resilient pad toward the pill receptacles to thereby provide downward force on pills protruding from the pill receptacles in addition to the orbital motion imparted thereto by the resilient pad.

10. A packaging device for a pill packaging apparatus, the packaging device for inserting pills into a series of pill receptacles being conveyed generally horizontally thereunder, said packaging device comprising:

a rotationally-driven shaft defining an axis; and a resilient pad coupled to the shaft in laterally displaced relation from the axis such that the resilient pad is eccentrically driven by the shaft in an orbital motion, the resilient pad capable of being brought into engagement with pills protruding from tie pill receptacles, the orbital motion of the resilient pad thereby urging protruding pills to lie flat in the receptacles.

11. A packaging device according to claim 10 further comprising an eccentric coupled between the shaft and the resilient pad, wherein the eccentric is adjustable to vary the lateral displacement of the resilient pad from the axis and to thereby vary the breadth of the orbital motion of the resilient pad.

12. A packaging device according to claim 10 wherein the resilient pad is comprised of a rubber material.

13. A packaging device according to claim 10 wherein the resilient pad comprises a frame having a fabric stretched tautly thereacross and attached thereto, the frame being configured to extend over the width of the pills such that only the fabric engages the pills protruding from the receptacles throughout the breadth of the orbital motion of the resilient pad.

14. A packaging device according to claim 13 wherein the fabric comprises a stainless steel cloth.

15. A packaging device according to claim 10 wherein the packaging device is further adapted to provide downward force on pills protruding from the pill receptacles in addition to the orbital motion imparted thereto by the resilient pad.

16. A packaging device according to claim 15 wherein the device is structured such that the weight of the resilient pad lowers the pad and provides downward force on pills protruding from the pill receptacles, in addition to the orbital motion imparted thereto by the resilient pad.

17. A packaging device according to claim 15 further including an urging device for urging the resilient pad toward said pill receptacles to thereby provide downward force on pills protruding from the pill receptacles in addition to the orbital motion imparted thereto by the resilient pad.

18. A packaging device for a pill packaging apparatus, the packaging device for inserting pills into a series of pill receptacles being conveyed generally horizontally thereunder, said packaging device comprising:

an eccentric adapted to be rotated about an axis; and a resilient pad coupled to the eccentric in such a manner that the resilient pad is laterally displaced from the axis and driven by the eccentric in an orbital motion, the resilient pad capable of being brought into engagement with pills protruding from the pill receptacles, the orbital motion of the resilient pad thereby urging the protruding pills to lie flat in the receptacles.

19. A packaging device according to claim 18 wherein the eccentric is adjustable to vary the lateral displacement of the resilient pad from the axis and to thereby vary the breadth of the orbital motion of the resilient pad.

20. A packaging device according to claim 18 wherein the resilient pad is comprised of a rubber material.

21. A packaging device according to claim 18 wherein the resilient pad comprises a frame having a fabric stretched tautly thereacross and attached thereto, the frame being configured to extend over the width of the pills such that only the fabric engages the pills protruding from the receptacles throughout the breadth of the orbital motion of the resilient pad.

22. A packaging device according to claim 21 wherein the fabric comprises a stainless steel cloth.

23. A packaging device according to claim 18 wherein the packaging device is further adapted to provide downward force on pills protruding from the pill receptacles in addition to the orbital motion imparted thereto by the resilient pad.

24. A packaging device according to claim 23 wherein the device is structured such that the weight of the resilient pad lowers the pad and provides downward force on pills protruding from the pill receptacles, in addition to the orbital motion imparted thereto by the resilient pad.

25. A packaging device according to claim 23 further including an urging device for urging the resilient pad toward the pill receptacles to thereby provide downward force on pills protruding from the pill receptacles in addition to the orbital motion imparted thereto by the resilient pad.

26. A method for packaging pills in individual receptacles in a blister package, said method comprising the steps of:

feeding pills into the receptacles;

engaging a resilient pad against any pills protruding from the pill receptacles; and imparting an orbital motion to the resilient pad by laterally displacing the resilient pad from an axis and then eccentrically driving the resilient pad about the axis, so as to urge the protruding pills to lie flat in the receptacles.

27. A method according to claim 26 further including the step of imparting a downward force on pills protruding from the receptacles following the step of moving the resilient pad adjacent to the receptacles.

* * * * *

UNITED STATES PATENT AND TRADEMARK OFFICE

CERTIFICATE OF CORRECTION

PATENT NO. : 6,494,022 B1
DATED : December 17, 2002
INVENTOR(S) : Aylward

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 4,122,651 | 10/1978 | Braverman |
| 6,269,615 | 8/2001 | Amborn et al. |
| 3,789,575 | 2/1974 | Bross |
| 5,802,804 | 9/1998 | Esposti et al. |
| 6,185,901 | 2/2001 | Aylward |
| 4,852,333 | 8/1989 | Illy --. |

Signed and Sealed this

Twentieth Day of May, 2003

JAMES E. ROGAN
*Director of the United States Patent and Trademark Office*